US009394676B2

(12) United States Patent
Morris

(10) Patent No.: US 9,394,676 B2
(45) Date of Patent: Jul. 19, 2016

(54) OVERFLOW CONTAINMENT ASSEMBLY

(71) Applicant: Kevin Morris, Jennings, MO (US)

(72) Inventor: Kevin Morris, Jennings, MO (US)

( * ) Notice: Subject to any disclaimer, the term of this patent is extended or adjusted under 35 U.S.C. 154(b) by 120 days.

(21) Appl. No.: 14/451,523

(22) Filed: Aug. 5, 2014

(65) Prior Publication Data

US 2016/0040418 A1 Feb. 11, 2016

(51) Int. Cl.
*E03D 11/02* (2006.01)
*E03D 11/13* (2006.01)

(52) U.S. Cl.
CPC ..... *E03D 11/13* (2013.01)

(58) Field of Classification Search
CPC ..... E03D 11/13
USPC ..... 4/427
See application file for complete search history.

(56) References Cited

U.S. PATENT DOCUMENTS

| | | | | |
|---|---|---|---|---|
| 4,204,285 | A | 5/1980 | Pak | |
| D310,407 | S | 9/1990 | Stairs, Jr. | |
| 6,457,188 | B1 | 10/2002 | Lindberg | |
| 6,709,422 | B2 | 3/2004 | Hessel et al. | |
| 6,944,892 | B1 | 9/2005 | Giolas | |
| 7,302,714 | B2 | 12/2007 | Orcutt | |
| 8,220,080 | B2 | 7/2012 | Sawalski et al. | |
| 9,169,628 | B2 * | 10/2015 | Komorita | E03D 11/00 |
| 2007/0157374 | A1 | 7/2007 | Morris | |

FOREIGN PATENT DOCUMENTS

| | | |
|---|---|---|
| WO | W02004099513 | 11/2004 |

* cited by examiner

*Primary Examiner* — Huyen Le

(57) ABSTRACT

A overflow containment assembly for containing an overflowed fluid from a toilet includes the toilet structured to have a bowl. A fitting is coupled to the bowl on the toilet. The fitting is positioned proximate a maximum fill level of the bowl. A bag is coupled to the fitting. The bag may receive a fluid from the fitting if the bowl on the toilet becomes overfilled.

8 Claims, 5 Drawing Sheets

OVERFLOW CONTAINMENT ASSEMBLY

BACKGROUND OF THE DISCLOSURE

Field of the Disclosure

The disclosure relates to containment devices and more particularly pertains to a new containment device for containing an overflowed fluid from a toilet.

SUMMARY OF THE DISCLOSURE

An embodiment of the disclosure meets the needs presented above by generally comprising a toilet structured to have a bowl. A fitting is coupled to the bowl on the toilet. The fitting is positioned proximate a maximum fill level of the bowl. A bag is coupled to the fitting. The bag may receive a fluid from the fitting if the bowl on the toilet becomes overfilled.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
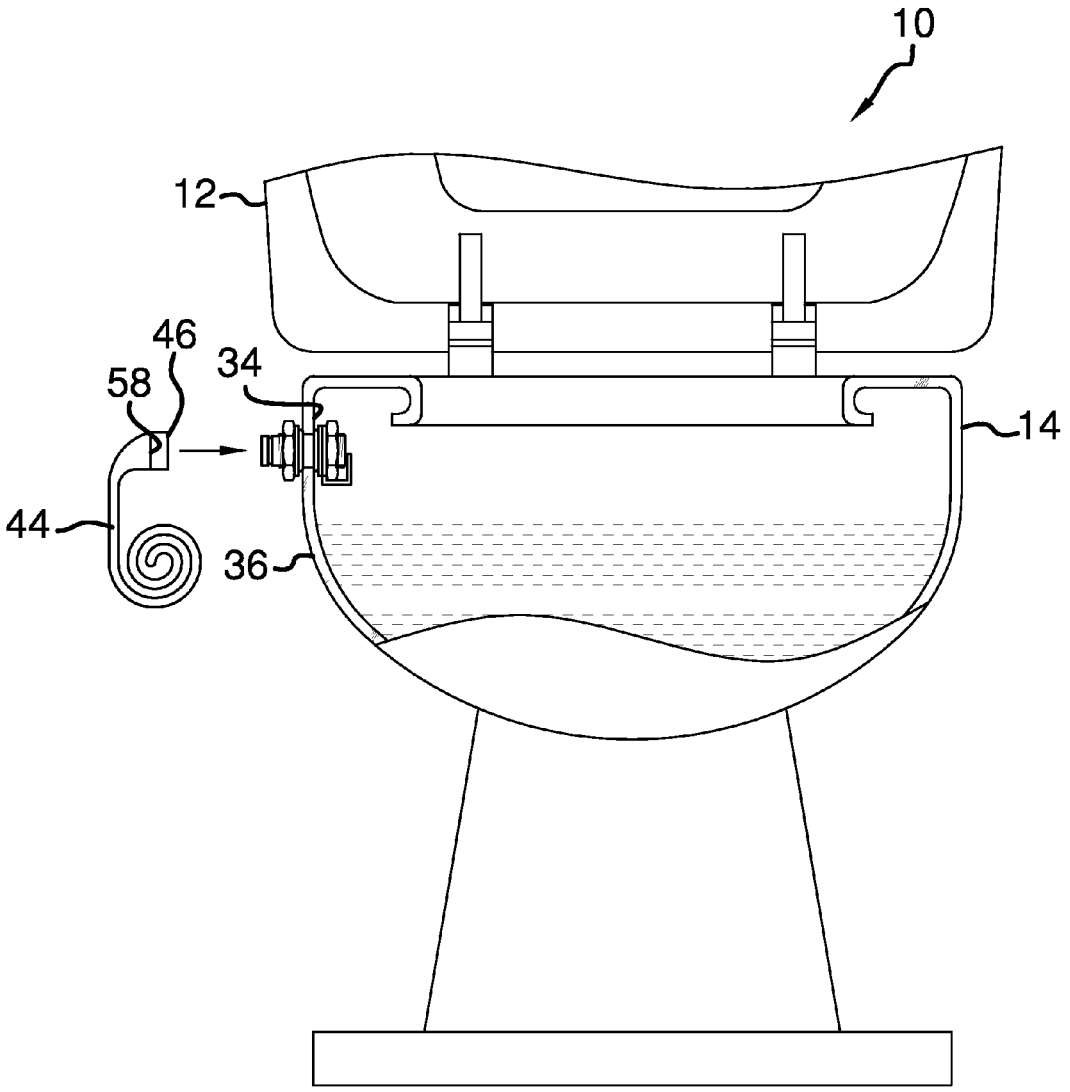
FIG. 1 is a front cutaway view of a overflow containment assembly according to an embodiment of the disclosure.
Figure 2:
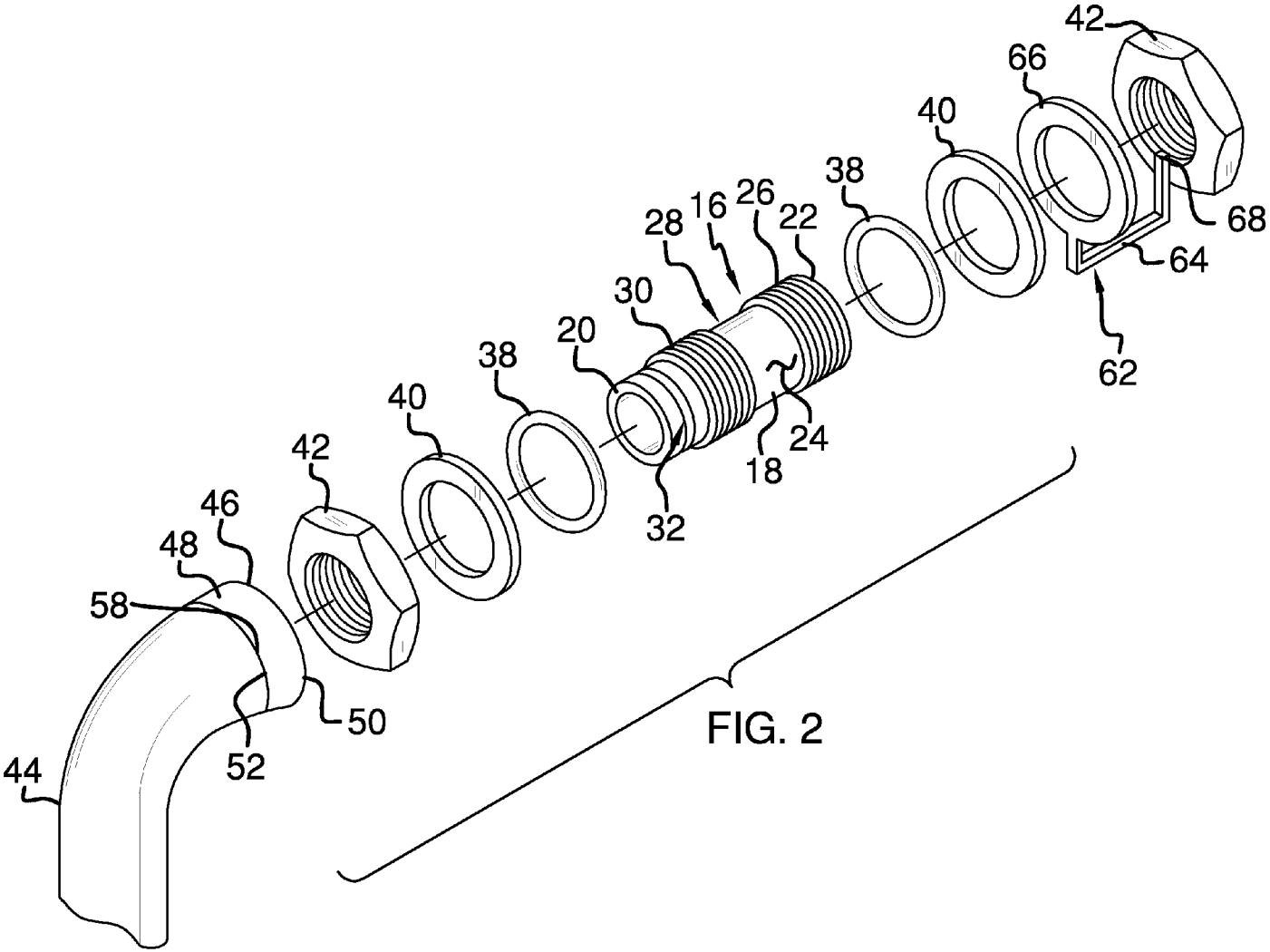
FIG. 2 is an exploded perspective view of an embodiment of the disclosure.
Figure 3:
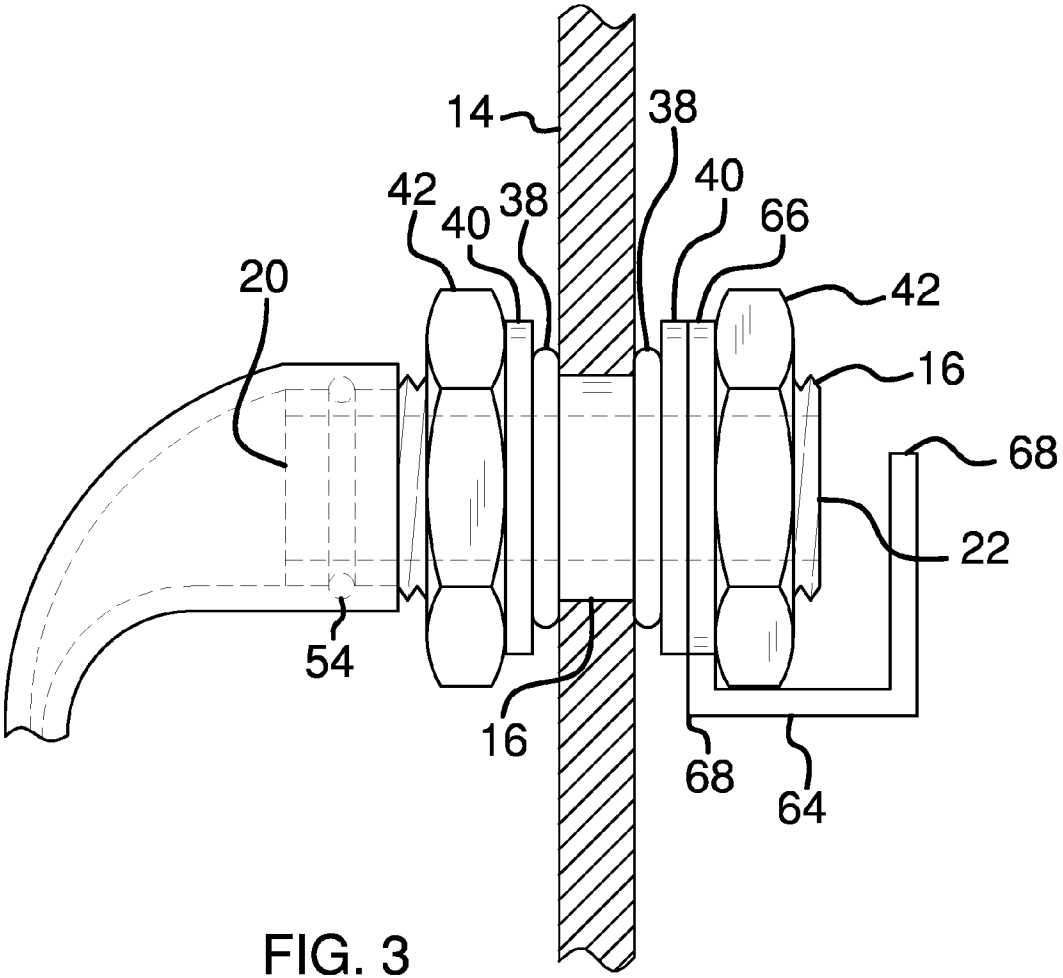
FIG. 3 is a front view of an embodiment of the disclosure.
Figure 4:
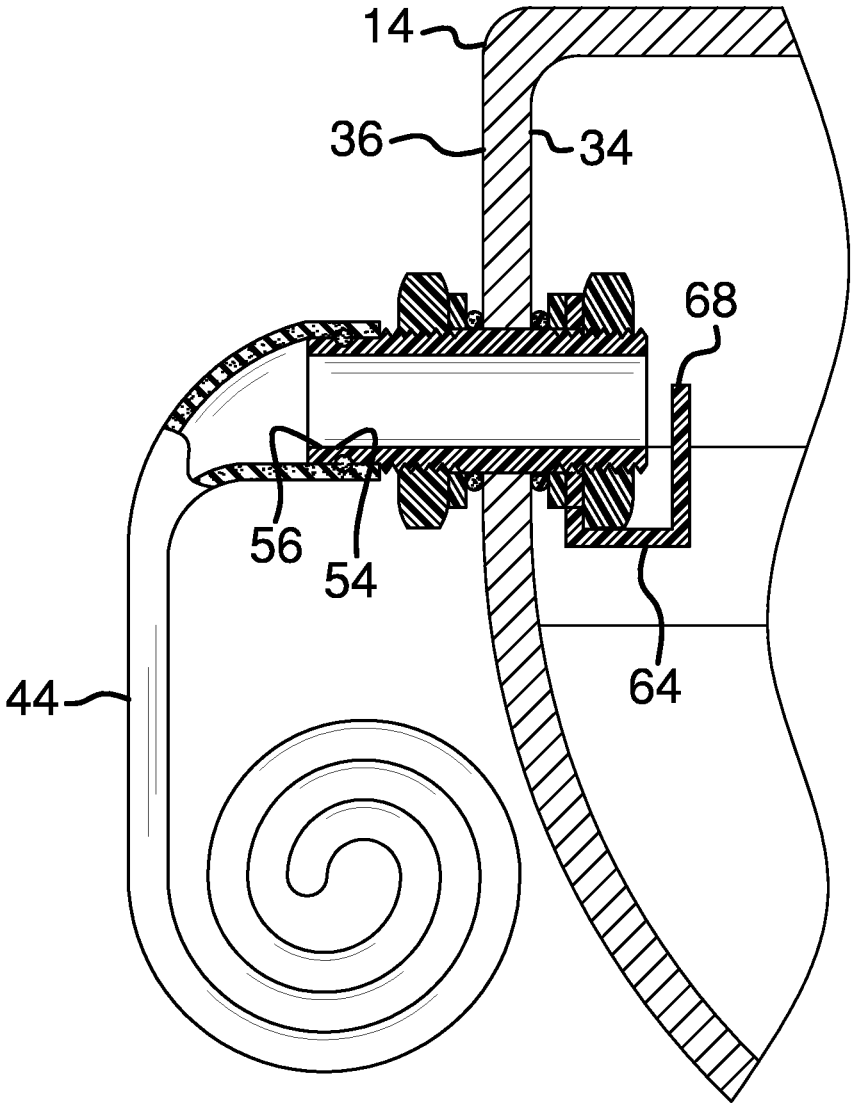
FIG. 4 is a cross sectional view taken along line 4-4 of FIG. 3 of an embodiment of the disclosure.
Figure 5:
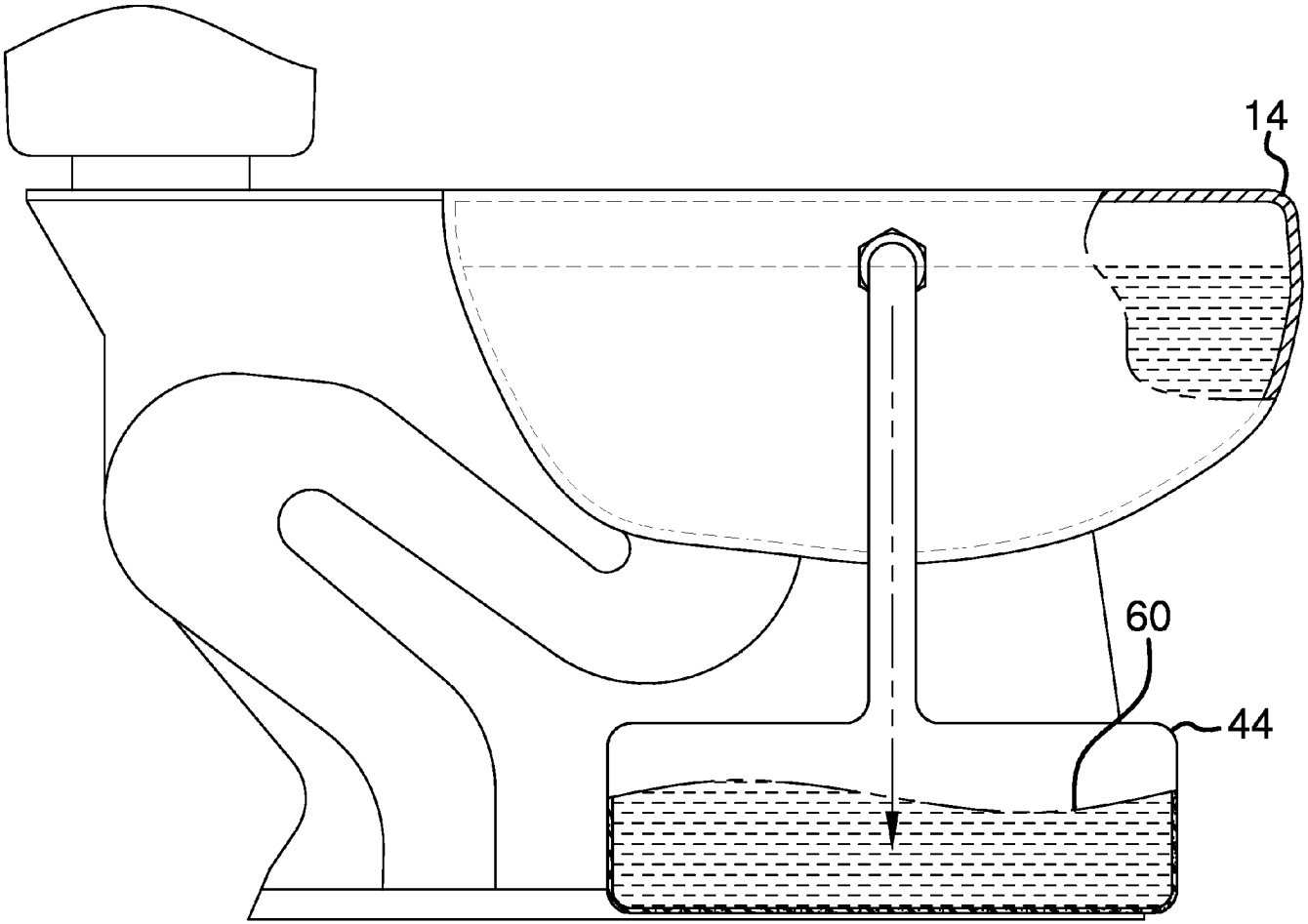
FIG. 5 is an in-use view of an embodiment of the disclosure.

With reference now to the drawings, and in particular to FIGS. 1 through 5 thereof, a new containment device embodying the principles and concepts of an embodiment of the disclosure and generally designated by the reference numeral 10 will be described.

As best illustrated in FIGS. 1 through 5, the overflow containment assembly 10 generally comprises a toilet 12 structured to have a bowl 14. The toilet 12 may be a toilet of any conventional design. A fitting 16 is provided. The fitting 16 has an outer wall 18 extending between each of a first end 20 and a second end 22 of the fitting 16. The fitting 16 has a tubular shape and the first 20 and second 22 ends of the fitting 16 are open. Additionally, the fitting 16 is substantially hollow.

An outer surface 24 of the outer wall 18 of the fitting 16 has a first threaded portion 26 extending from the second end 22 of the fitting 16 toward a center 28 of the fitting 16. The outer surface 24 of the outer wall 18 of the fitting 16 has a second threaded portion 30 extending from the center 28 of the fitting toward the first end 20 of the fitting 16. The outer surface 24 of the outer wall 18 of the fitting 16 is smooth between the second threaded portion 30 and the first end 20 of the fitting 16.

The outer surface 24 of the outer wall 18 of the fitting 16 has a retainer groove 32 extending inwardly therein. The retainer groove 32 extends around an entire circumference of the outer wall 18 of the fitting 16. Moreover, the retainer groove 32 is positioned between the first end 20 of the fitting 16 and the second threaded portion 30 of the fitting 16. The fitting 16 extends laterally through an inner 34 and an outer 36 surface of the bowl 14 of the toilet 12. The fitting 16 is in fluid communication with an interior of the bowl 14 of the toilet 12.

A pair of gaskets 38 are provided. The pair of gaskets 38 form a closed loop. Each of the pair of gaskets 38 are positioned around the fitting 16. The pair of gaskets 38 each abuts an associated one of the inner 34 and outer 36 surfaces of the bowl 14 of the toilet 12. Additionally, the pair of gaskets 38 forms a fluid impervious seal between the fitting 16 and the bowl 14 of the toilet 12.

A pair of washer 40 are provided. The pair of washers 40 forms a closed loop. Each of the pair of washers 40 are positioned around the fitting 16 to abut an associated one of the pair of gaskets 38. A pair of nuts 42 are provided. Each of the pair of nuts 42 threadably engages an associated one of the first 26 and second 30 threaded portions of the fitting 16. The pair of nuts 42 each engages an associated one of the pair of washers 40 so the fitting 16 is retained in the bowl 14 of the toilet 12.

A bag 44 is provided. The bag 44 is rolled upon itself so the bag 44 forms a spiral shape. Additionally, the bag 44 may be comprised of a fluid impermeable material.

A retainer 46 has an exterior wall 48 extending between each of a front end 50 and a back end 52 of the retainer 46. The front 50 and back 52 ends of the retainer 46 are open. Additionally, the retainer 46 is substantially hollow.

An O-ring 54 is coupled to an inside surface 56 of the exterior wall 48 of the retainer 46. The O-ring 54 extends around an entire circumference of the retainer 46. The O-ring 54 is centrally positioned on the retainer 46. Additionally, the back end 52 of the retainer 46 is coupled to a top end 58 of the bag 44.

The retainer 46 engages the first end 20 of the fitting 16. The O-ring 54 engages the retainer groove 32 in the fitting 16 so the bag 44 is fluidly coupled to the fitting 16. The bag 44 may receive a fluid 60 from the fitting 16 if the bowl 14 on the toilet 12 becomes overfilled. The bag 44 unrolls as the bag 44 receives the fluid 60 from the fitting 16. Moreover, the bag 44 is elongated when the bag 44 becomes full of the fluid 60. The fluid 60 may be water.

A strainer 62 is provided. The strainer 62 has a finger 64 coupled to and extending forwardly from a washer 66. The washer 66 forms a closed loop. The finger 64 has a centrally positioned bend. Additionally, the finger 64 has an L-shape. A free end 68 of the finger 64 is directed upwardly from the washer 66. The strainer 62 is positionable between an associated one of the pair of washers 40 and an associated one of the pair of nuts 42. The finger 64 prevents debris from entering the fitting 16.

In use, the bag 44 receives the fluid 60 from the bowl 14 of the toilet 12 if the toilet 12 overflows. The retainer 46 is removed from the fitting 16 after the bag 44 has become filled with the fluid 60. The bag 44 is disposed of after the filled bag 44 is removed from the fitting 16. A replacement bag 44 and retainer 46 are coupled to the fitting 16 after the filled bag 44 is removed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An overflow containment assembly comprising:

a toilet structured to have a bowl;

a fitting coupled to said bowl on said toilet such that said fitting is positioned proximate a maximum fill level of said bowl, said fitting having an outer wall extending between each of a first end and a second end of said fitting such that said fitting has a tubular shape, said first and second ends of said fitting being open, said fitting being substantially hollow;

a bag coupled to said fitting such that said bag is configured to receive a fluid from said fitting if said bowl on said toilet becomes overfilled; and an outer surface of said outer wall of said fitting having a retainer groove extending inwardly therein, said retainer groove extending around an entire circumference of said outer wall of said fitting, said retainer groove being positioned proximate said first end of said fitting.

2. The overflow containment assembly according to claim 1, further comprising said fitting extending laterally through an inner and an outer surface of said bowl of said toilet such that said fitting is in fluid communication with an interior of said bowl of said toilet.

3. The overflow containment assembly according to claim 1, further comprising a retainer having an exterior wall extending between each of a front end and a back end of said retainer, said front and back ends of said retainer being open, said retainer being substantially hollow.

4. An overflow containment assembly comprising:

a toilet structured to have a bowl;

a fitting coupled to said bowl on said toilet such that said fitting is positioned proximate a maximum fill level of said bowl; and a bag coupled to said fitting such that said bag is configured to receive a fluid from said fitting if said bowl on said toilet becomes overfilled;

a retainer having an exterior wall extending between each of a front end and a back end of said retainer, said front and back ends of said retainer being open, said retainer being substantially hollow; and an O-ring coupled to an inside surface of said exterior wall of said retainer such that said O-ring extends around an entire circumference of said retainer, said O-ring being centrally positioned on said retainer.

5. The overflow containment assembly according to claim 4, further comprising said back end of said retainer being coupled to a top end of said bag.

6. The overflow containment assembly according to claim 5, further comprising said retainer engaging a first end of said fitting such that said O-ring engages a retainer groove in said fitting such that said bag is removably and fluidly coupled to said fitting.

7. The overflow containment assembly according to claim 6, further comprising said bag being rolled upon itself such that said bag forms a spiral shape, said bag unrolling as said bag receives the fluid from said fitting such that said bag is elongated when said bag becomes full of the fluid.

8. An overflow containment assembly comprising:

a toilet structured to have a bowl;

a fitting having an outer wall extending between each of a first end and a second end of said fitting such that said fitting has a tubular shape, said first and second ends of said fitting being open, said fitting being substantially hollow;

an outer surface of said outer wall of said fitting having a retainer groove extending inwardly therein, said retainer groove extending around an entire circumference of said outer wall of said fitting, said retainer groove being positioned proximate said first end of said fitting;

said fitting extending laterally through an inner and an outer surface of said bowl of said toilet such that said fitting is in fluid communication with an interior of said bowl of said toilet;

a bag, said bag being rolled upon itself such that said bag forms a spiral shape;

a retainer having an exterior wall extending between each of a front end and a back end of said retainer, said front and back ends of said retainer being open, said retainer being substantially hollow; and an O-ring coupled to an inside surface of said exterior wall of said retainer such that said O-ring extends around an entire circumference of said retainer, said O-ring being centrally positioned on said retainer, said back end of said retainer being coupled to a top end of said bag, said retainer engaging said first end of said fitting, said O-ring engaging said retainer groove in said fitting such that said bag is fluidly coupled to said fitting wherein said bag is configured to receive a fluid from said fitting if said bowl on said toilet becomes overfilled, said bag unrolling as said bag receives the fluid from said fitting such that said bag is elongated when said bag becomes full of the fluid.

* * * * *